US006643886B2

(12) United States Patent
Moskovich et al.

(10) Patent No.: US 6,643,886 B2
(45) Date of Patent: Nov. 11, 2003

(54) TOOTHBRUSH HAVING AN EFFICACIOUS BRISTLE PATTERN

(75) Inventors: Robert Moskovich, East Brunswick, NJ (US); Kenneth Waguespack, North Brunswick, NJ (US); Eyal Eliav, NYC, NY (US); Eric Chan, New York, NY (US); Kyoungeun Ahn, New York, NY (US)

(73) Assignee: Colgate Palmolive Company, New York, NY (US)

( * ) Notice: Subject to any disclaimer, the term of this patent is extended or adjusted under 35 U.S.C. 154(b) by 111 days.

(21) Appl. No.: 09/788,929

(22) Filed: Feb. 20, 2001

(65) Prior Publication Data

US 2001/0042280 A1 Nov. 22, 2001

Related U.S. Application Data

(63) Continuation-in-part of application No. 29/123,437, filed on May 18, 2000, now Pat. No. Des. 440,767, which is a continuation-in-part of application No. 29/129,978, filed on Sep. 26, 2000, now Pat. No. Des. 451,284.

(51) Int. Cl.[7] ..... A46B 9/04
(52) U.S. Cl. ..... 15/167.1; 15/DIG. 5
(58) Field of Search ..... 15/DIG. 5, 167.1; D4/104, 105

(56) References Cited

U.S. PATENT DOCUMENTS

| | | | | |
|---|---|---|---|---|
| 5,335,389 | A | | 8/1994 | Curtis et al. |
| 5,341,537 | A | | 8/1994 | Curtis et al. |
| 5,446,940 | A | | 9/1995 | Curtis et al. |
| 5,459,899 | A | | 10/1995 | Bauer |
| 5,628,082 | A | | 5/1997 | Moskovich |
| 5,742,972 | A | | 4/1998 | Bredall et al. |
| D421,845 | S | * | 3/2000 | Beals |
| D422,143 | S | | 4/2000 | Beals et al. |
| D425,306 | S | | 5/2000 | Beals et al. |
| 6,138,315 | A | | 10/2000 | Schmitt et al. |
| D440,767 | S | | 4/2001 | Moskovich et al. |
| D462,525 | S | * | 9/2002 | Grau et al. |

FOREIGN PATENT DOCUMENTS

| | | | |
|---|---|---|---|
| CH | 681771 | A5 | 5/1993 |
| DE | 4412301 | A1 | 10/1995 |
| JP | 0814740 | A | 6/1996 |
| JP | 11-290128 | A | 10/1999 |

OTHER PUBLICATIONS

U.S patent application Ser. No. 29/129,978 filed Sep. 26, 2000, Related Pending Application.

* cited by examiner

*Primary Examiner*—Randall E. Chin
(74) *Attorney, Agent, or Firm*—Henry S. Goldfine

(57) ABSTRACT

The present invention relates to an enhanced cleaning toothbrush bristle pattern, wherein two rows of taller bristle tufts transversely divide the toothbrush head into three sections, the bristle tufts within each section having a trim pattern which in profile is convex in relation to the toothbrush face; wherein the two rows of taller bristle tufts penetrate between teeth, while the curved trim profile of each section provides for good conformity to the curved tooth surfaces and for an improved sweeping action.

7 Claims, 4 Drawing Sheets

TOOTHBRUSH HAVING AN EFFICACIOUS BRISTLE PATTERN

This is a continuation-in-part of prior application Ser. Nos. 29/123,437 filed May 18, 2000 now U.S. Pat. No. D440,767 and Ser. No. 29/129,978 filed Sep. 26, 2000 now U.S. Pat. No. D451,284 which applications are now pending and is incorporated herein by reference.

FIELD OF THE INVENTION

The present invention relates to toothbrushes, and more particularly, to toothbrushes having a particular bristle pattern which by penetrating into the interproximal spaces between the teeth and which by providing an improved sweeping effect, in combination enhanced the cleaning of the tooth surfaces.

BACKGROUND OF THE INVENTION

The primary purpose of a toothbrush is to clean the teeth by removing plaque and debris from the tooth surfaces, including the curved outer tooth surfaces and the interproximal surfaces between the teeth, i.e. the topography of the teeth. To facilitate such cleaning, conventional toothbrushes comprise generally uniform length tufts of bristles, a flat bristle trim, each bristle having a first end which is held captive in and fixed to a brush head, and a second, free end, which is used for brushing. Toothbrushes having such a generally flat bristle trim are limited in their ability to conform to the curvature of the teeth, to penetrate into the interproximal areas between the teeth and to sweep away the plaque and debris as bristles within a flat bristle trim tend to interfere with each other.

The desire of users to cause brushes having such conventional flat bristle trims to conform to the curvature of the teeth and to penetrate into the interproximal spaces between the teeth expressed by the forceful application of the brush to adequately deform the bristles to the tooth topography. Such forceful application of the brush causes excessive, deleterious wear of the tooth surfaces and gums, without providing adequate conformation of the brush about and between the teeth to yield the desired cleaning.

U.S. Pat. No. 5,742,972 discloses a toothbrush having a bristle trim containing at the toe region of the head, furthest from the handle, a ramping down subset of bristle tufts with the longest bristle tuft adjacent to the toe. Along the heel region of the head, closest to the handle, is a plurality of bristle rows trimmed along the longitudinal axis of the head in the form of a trough. This combination of bristle trim is designed to provide enhanced interproximal and gingival margin cleaning by better conforming to the curved surfaces of and between the teeth. While this combination of tufts does provide better conformity to the topography of the teeth than a conventional uniform length, flat trim toothbrush; it does not have the spacing and diversity of tufts and trim necessary to provide the desired conformity to and between the teeth for enhanced cleaning of the tooth surfaces.

Alternately, U.S. Pat. Nos. 5,335,389, 5,341,537, 5,446,940 and 5,459,899 disclose various other toothbrushes containing combinations of longer and shorter bristle tufts and bristle bars, which are generally orthogonal to the face of the disclosed toothbrushes, but do include acutely angled bristle groupings, either as discrete bristle tufts and/or continuous bristle bars. As in the case of U.S. Pat. No. 5,742,972, the bristle patterns of these toothbrushes will better conform to and between the curved surfaces of the teeth than a conventional flat trim pattern; but, as in the case of U.S. Pat. No. 5,742,972, the spacing and diversity of bristle groupings does not provide the enhanced conformity to and between the teeth for the desired cleaning.

U.S. Design Pat. Nos. 422,143 and 425,306 disclose bristle patterns characterized by a generally flat bristle trim and three spaced apart, bristle bars disposed transverse to the longitudinal axis of the toothbrush head and spaced away from the ends of the brush head. As conventional toothbrush heads are generally about 3 cm in length, such three bristle bars dispositions, spaced away from the ends of the brush head, would allow only about 2 centimeters of longitudinal brush head length for the three bristle bars, i.e. the bristle bars being at most 1 cm apart. Considering the trend toward larger adult molars of 1 cm or more across, the at most spacing of 1 cm between the bristle bars disclosed within the subject design patents will not facilitate the bristle bars penetration into the interproximal spaces between such molars. Further, the presence of three bristle bars, with such a spacing, that extend transversely across the brush head will tend to cause at least one of the bristle bars to abut against the surface of one of the smaller anterior teeth such as the incisors, so as prevent the other bristle bars from penetrating into and cleaning the interproximal spaces between such teeth. Without easy penetration by the bristle bars into the interproximal spaces the user will tend to apply excessive brushing pressure to force the bristle bars to penetrate about the sides of the molars and between the incisors, cuspids, bicuspids and molars, causing the deleterious wear discussed above.

There is a need in the art for a toothbrush having a bristle pattern with the ability to easily penetrate into the interproximal spaces, to better conform to the curvature of the teeth, and to provide a better sweeping effect, in combination to provide improved dentiture cleaning, without the need for the application of excessive and deleterious brushing force.

BRIEF SUMMARY OF THE INVENTION

The present invention comprises a toothbrush with an elongated head connected to an elongated handle, which head is divided into three sections by two rows of bristle tufts or bristle bars oriented transversely across the head, extending in height at least about 1.0 cm above the face of the toothbrush and spaced at least 1.2 cm apart; wherein, the first section, located nearest the toe of the brush, contains at least two rows of bristle tufts oriented transversely across the brush head, wherein the trim profile of the bristle tufts which comprise these rows is curved, having a first radius of curvature convex with respect to the toe of the toothbrush; and wherein the second section, located between the two transverse rows of bristle tufts, contains a plurality of rows of bristle tufts with a curved trim profile, having a second radius of curvature convex to the face of the toothbrush; and wherein, the third section, located nearest the handle of the toothbrush, contains at least two transverse rows of bristle tufts with a curved trim profile, having a third radius of curvature convex with respect to the handle end of the toothbrush head; which combination of features provides a configuration of bristle tufts able to conform to the curvature of the tooth, while more easily penetrating the interproximal spaces between the teeth, and providing a better sweeping effect to remove plaque and debris from both the surface of and between the teeth.

A second embodiment of the present invention comprises the three sections of bristle tufts of the first embodiment described above; except, rather than the bristle trim profiles of the three sections of bristle tufts being curved, the trim profile of each section is a flat plane or combination of flat planes. Specifically, the profile trim of the free ends of the first and third sections each lie in a flat plane angled downward toward the center of the face of the toothbrush head from the respective ends of the head. The profile trim of the free ends of the second, center section, is an inverted "V", formed of two flat planes with an apex at its center, each plane respectively descending toward the toe and handle ends of the head. This profile bristle trim allows further separation between the bristles ends to facilitate an enhanced sweeping effect, to provide enhanced cleaning of the tooth surfaces.

A third embodiment of the present invention comprises the three sections of bristle tufts of the first embodiment, wherein the bristle tufts in the second section are comprised of an inner grouping of bristle tufts, located central to the toothbrush face, which inner grouping is acutely angled toward either the toe or handle end of the toothbrush head and an outer grouping of bristle tufts located about the periphery of the face, which outer grouping is acutely angled toward the opposite end of the head than the inner grouping. The rows of bristle tufts within both the inner and outer groupings may be arranged in columns which are generally aligned with and parallel to the longitudinal axis of the brush head. This third embodiment further enhances the ability of the toothbrush to penetrate into the interproximal spaces as the toothbrush is moved horizontally back and forth in the mouth.

BRIEF DESCRIPTION OF THE DRAWINGS

While the specification concludes with the claims which particularly point out and distinctly claim the invention, it is believed the present invention will be better understood from the following description of several particularly preferred embodiments taken in conjunction with the accompanying drawings, in which like reference numerals identify similar elements and wherein:

DETAILED DESCRIPTION THE PREFERRED EMBODIMENT

Figure 1:
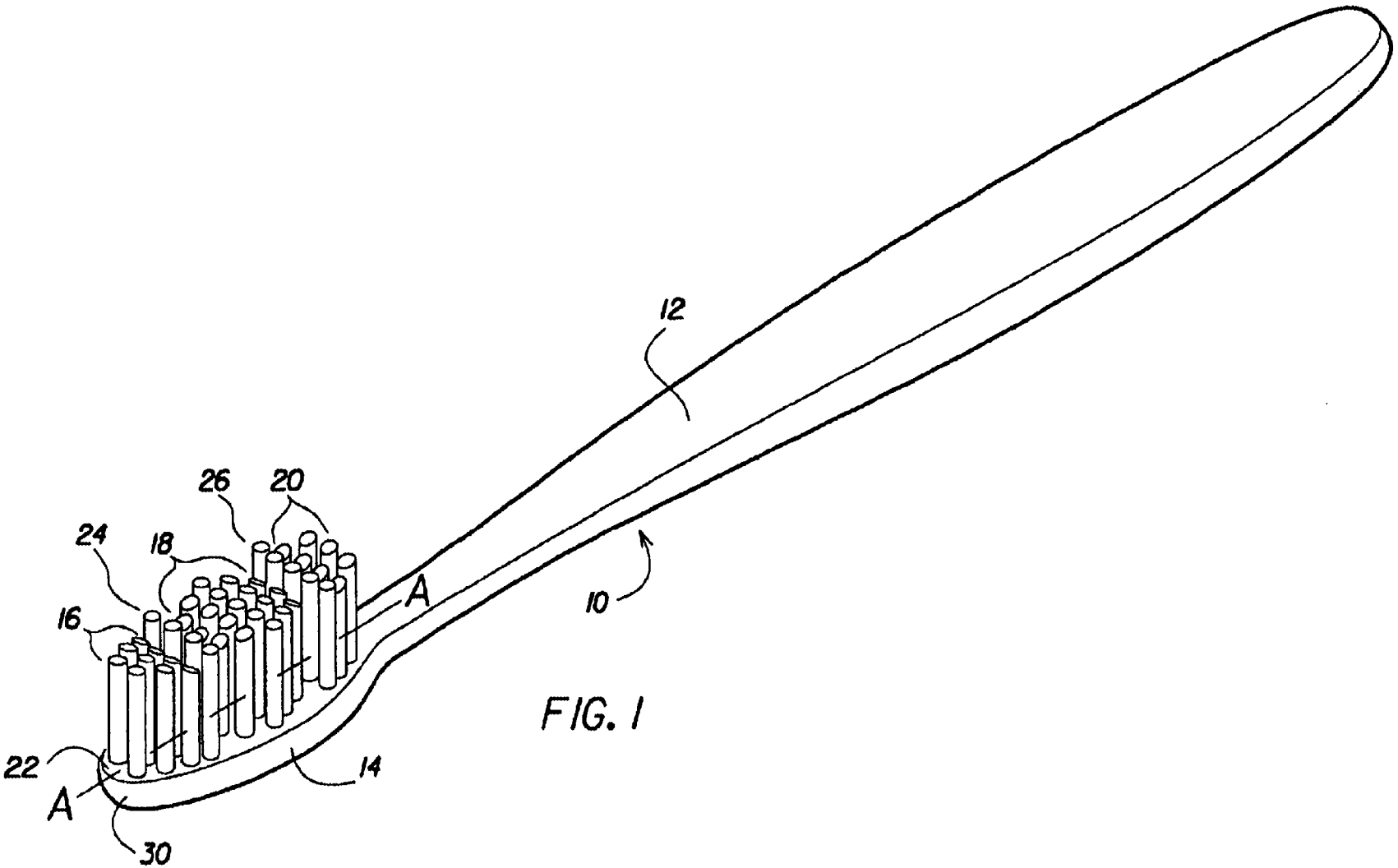
FIG. 1 is a perspective view, showing a toothbrush embodying the toothbrush bristle pattern of the present invention; wherein the particular handle that is shown is arbitrarily chosen and is not part of the invention described and claimed herein.

Referring now to FIG. 1, a perspective view of a toothbrush 10, showing a typical elongated handle 12 and an elongated head 14 with two extended rows of bristle tufts, 24 and 26, oriented transverse to the longitudinal axis of the brush head A—A. The two transverse rows 24, 26 are of a length as great or greater than any of the other bristle tufts in the toothbrush head 14, a length which is at least 1.0 cm and preferably at least 1.2 cm in height above the face 22 of the toothbrush 10. The two transverse rows 24, 26 which as shown are formed of distinct bristle tufts, or alternatively of continuous bristle bars, are spaced at least 1.2 cm, preferably at least 1.3 cm and most preferably at least 1.5 cm apart and are located on the brush face 22 so as to divide the toothbrush head into three sections of bristle tufts 16, 18 and 20. The free ends of the three sections of bristle tufts 16, 18 and 20 have a profile bristle trim which is in the form of a convex curve in relation to the face 22, which trim profiles facilitate an improved sweeping action as there is less interference between the bristles and a better conformity to the curvature between the teeth. The combination of such profile bristle trim with the two transverse rows of bristle tufts or bars 24, 26 that are spaced apart to allow each to penetrate into interproximal spaces without impeding the penetration of the other, embodies the features and construction of this invention to provide the desired enhanced cleaning of the dentiture.

Figure 2:
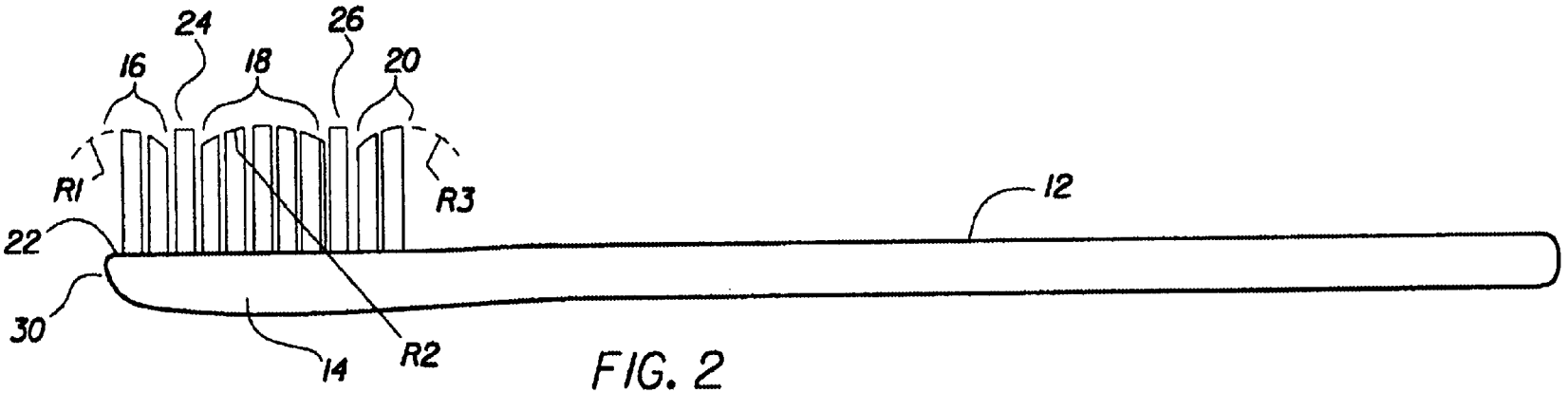
FIG. 2 is a side elevation of the embodiment of FIG. 1.
Figure 3:
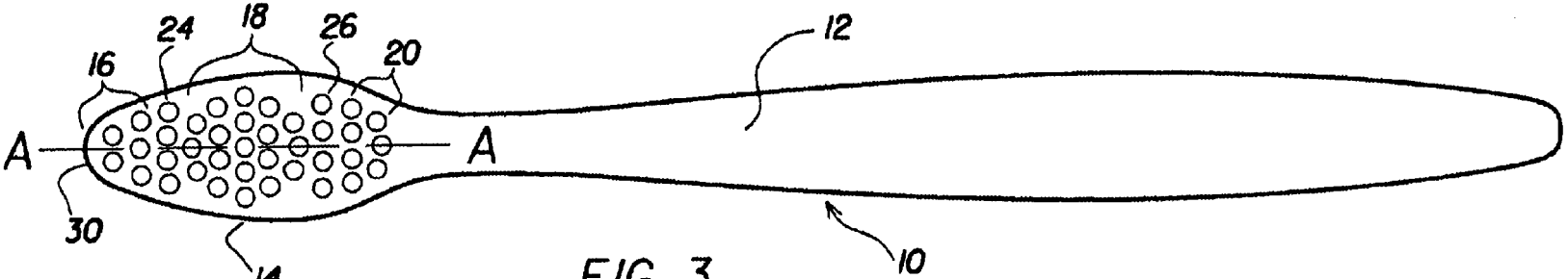
FIG. 3 is a top plane view of the embodiment of FIG. 1.
Figure 2A:
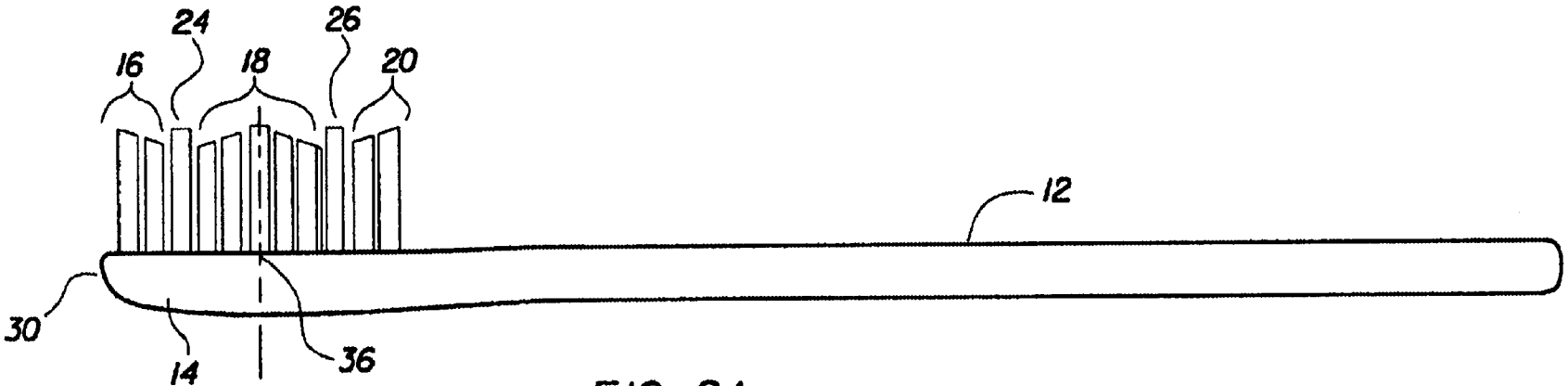
FIG. 2A is a side elevation of a second embodiment of the present invention, wherein the free ends of the three sections of bristle tufts, separated by the two extended transverse rows of bristle tufts, lie in flat planes rather than curved planes as the case in the embodiment shown in FIGS. 1 and 2.
Figure 4:
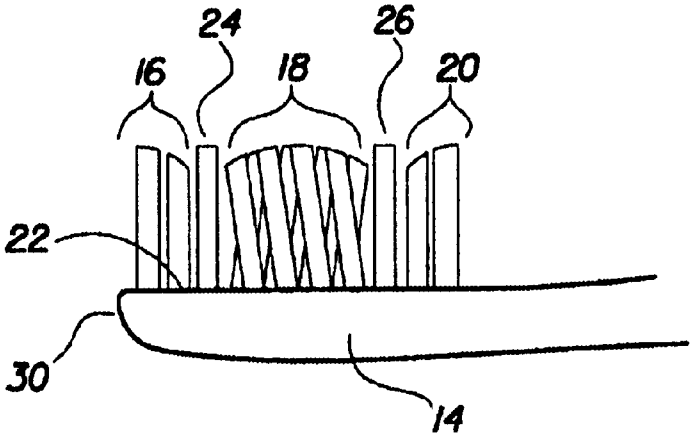
FIG. 4 is a side elevation view, showing a third embodiment of the toothbrush bristle pattern of the present invention, wherein only the brush head is shown.
Figure 5:
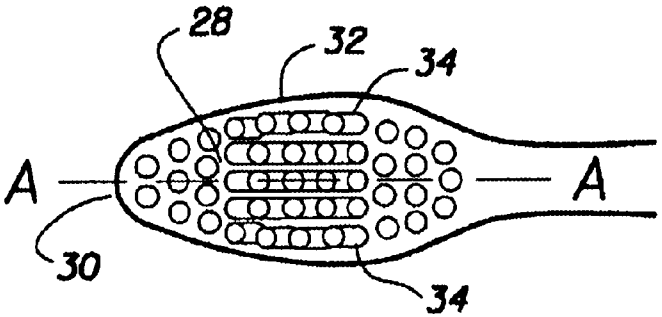
FIG. 5 is a top plane view of the embodiment of FIG. 4.

Referring the first and third bristle tuft sections 16 and 20, as shown in FIGS. 2 and 3, each of such sections contains at least 2 generally parallel rows of one or more bristle tufts, oriented generally transverse to the longitudinal axis A-A of the toothbrush head 14. The top view layout of the bristle tuft of the second section 18 may be comprised of a plurality of generally parallel rows and columns of bristle tufts generally aligned and perpendicular to the longitudinal axis A—A of the toothbrush head 14, i.e. laid-out in a Cartesian coordinate pattern as shown in FIG. 5. Alternatively, as shown in FIG. 3, the top view layout of bristle tufts in the second section 18 can be a series of concentric circles or other geometric shapes, such as a series of concentric diamonds, as long as the profile trim of the free ends thereof is as shown in FIGS. 2, 2A or 4, and described herein.

Referring to FIG. 2, it can be seen that the free ends of the first bristle tuft section 16, nearest the toe 30 of the toothbrush 10, have a curved bristle trim profile, i.e. the side view, or profile, of the free ends are cut to lie in a curved plane with a radius of curvature R1, which is convex in relation to the toe 30 of the toothbrush 10. Correspondingly, the free ends of the third section of bristle tufts 20, nearest the handle of the toothbrush 12, also have a curved bristle trim profile with a radius of curvature R3, which may be the same or different than R1 and is convex toward the handle 12 end of the toothbrush head 14. Preferably, both R1 and R3 are radii of curvature of from about 15 cm to about 20 cm, and most preferably from 16 to 19 cm.

Continuing to refer to FIG. 2, it can be seen that the free ends of the second section of bristle tufts 18, which lies between the two transverse rows of bristle tufts 24, 26, has a curved trim profile with a radius of curvature R2, which is convex in relation to the center of the toothbrush face 22. Preferably, R2 is a radius of curvature of from about 9 cm to about 15 cm, and most preferably from 11 to 14 cm.

The bristle tufts used within the present invention are meant to be flexible to easily conform to and between the curvature of the dentiture. Such flexible bristle tufts are generally at least about 1.0 cm in height, or length, above the face 22 of the toothbrush head 14 and preferably have a round cross-section of at least from about 0.254 mm to about 1.27 mm in diameter, with corresponding cross-sectional areas of about 0.00645 $cm^2$ to about 0.03871 $cm^2$. The bristle bars differ from the bristle tufts shown in FIG. 1, in that the bristle tufts are discrete bunches or groupings of bristles as just described; whereas, the bristle bars are a plurality of adjacent tufts or individual bristles which are closely spaced, such that to the user the bristle bar appears to be a continuous bar of bristles at least 0.5 cm in length and preferably 0.8 cm in length, and at least about 0.8 mm and preferably 1.0 mm across.

In addition to being flexible, it is preferred that the bristles within the present invention be soft enough to penetrate the gingival margin and remove debris and plaque without causing irritation and bleeding. It is preferred that the bristles be end-rounded and have a diameter be between about 0.0762 mm and about 0.3048 mm, most preferred between 0.127 mm and 0.2032 mm.

A second embodiment of the present invention is shown in FIG. 2A, wherein, the free ends the bristle tufts of the first and third sections lie in flat planes, respectively sloped downward toward the center 36 of the head 14, and the free ends the bristle tufts of the second section 18 lie in two flat planes, respectively sloped downward toward the face 22 from an apex in an inverted "V" shape; the apex being generally at the center 36 of the head 14, along a center line B—B. The grade of the respective slopes can be up to about 20 percent, i.e. 2 units down per 10 units of length.

Referring to FIGS. 4 and 5, which represent a third embodiment of the present invention, which third embodiment is identical to the first embodiment described above; except, that the second section of bristle tufts 18, contains a grouping of inner bristle tufts 28, central to the head 14, which inner grouping is separated from the edge of the brush face 32 by at least one row of outer bristle tufts 34 located on the periphery, i.e. each side, of the head 14. The grouping of inner bristle tufts 28 is acutely angled with respect to the face 22 of the toothbrush head 14, either toward or away from the toe 30 of the toothbrush head 14. Correspondingly, the outer bristle tufts 34 are angled at an equal or different angle in the opposite direction, e.g. angled away from the toe 30, if the inner grouping of bristle tufts 28 are angled toward the toe, as shown in FIG. 4. The acute angle between the peripheral outer bristle tufts 34 and the face 22, and the inner grouping of bristle tufts 28 and the face 22, is from about 78 to 89 degrees and preferably from about 80 to about 89 degrees and most preferably from about 80 to 85. Such oppositely angled outer bristle tufts 34 and inner grouping of bristle tufts 28 provide for enhanced interproximal penetration of these particular bristle tufts as the toothbrush is moved horizontally by the user across the surfaces of the posterior and anterior teeth, a common brushing action.

Any conventional flexible bristle material may be utilized in the present invention. Nylon and polyester are preferred bristle materials, with nylon being the most preferred. A preferred brand of nylon, 6,12 nylon, is available from E.I. DuPont de Nemours and Company of Wilmington, Del. under the tradenamne of TYNEX®.

The bristles may be implanted in the toothbrush face 22 in tufts using either typical staple technology or using more modern non-staple technology as disclosed in U.S. Pat. Nos. 4,635,313, 4,637,660, 4,954,305, 5,045,267, 5,390,984, 5,533,791, 5,609,890, and 5,823,633. Such non-staple technology involves processes wherein the bristle tufts are fused into the face 22 of the toothbrush head 14, by heating both the bristle tufts and the head 14, which are then brought together; or, wherein the ends of the bristle tufts are pre-positioned in an injection mold prior to the introduction of the toothbrush material, which toothbrush material is subsequently injected about the ends of the bristle tufts, locking the bristle tufts in place in the face 22 of the toothbrush head 14.

What is claimed is:

1. An enhanced cleaning toothbrush comprising:

(a) an elongated handle (12);

(b) an elongated head (14) connected to and extending from the handle (12), the head (14) ending in a toe (30) distal from the handle(12), (c) the elongated head (14) having a face (22) on one side thereof and a longitudinal axis (A—A) therethrough;

(d) a plurality of flexible bristle tufts, each with one end secured to said face (22) and the other, free end, extending therefrom;

(e) said head (14) being divided, by two rows of bristle tufts (24, 26) extending in height at least 1.0 cm above the face (22), which rows are oriented generally transverse to the longitudinal axis (A—A) and extend substantially across the toothbrush head (14), into a first section of bristle tufts (16) adjacent to the toe (30) and having a curved trim profile with a first radius of curvature (R1) convex to the toe (30); a second section of bristle tufts (18) located between the two rows of bristle tufts (24, 26) having a curved trim profile with a second radius of curvature (R2) convex to the brush face (22), and having an inner grouping of bristle tufts (28) located central to the head 14, which inner grouping (28) is acutely angled toward either the toe (30) or handle end of the head 14, and having peripheral to said inner grouping (28), outer groupings of bristle tufts (34) located adjacent to each side of the brush head (14), which outer groupings (34) are acutely angled toward the opposite end of the brush head than the inner grouping (28); and a third section of bristle tufts (20) located adjacent to the handle (12) and having a curved trim profile with a third radius of curvature (R3) convex to the handle (12);

(f) the two rows of bristle tufts (24, 26) being spaced at least 1.2 cm apart.

2. The toothbrush of claim 1, wherein both the first (16) and third (20) sections of bristle tufts each contains at least two rows of bristle tufts, which rows are generally oriented transverse to the longitudinal axis of the toothbrush (A—A).

3. The toothbrush of claim 1, wherein the first (R1) and third (R3) radii of curvature are the same or different and are from about 15 cm to about 20 cm.

4. The toothbrush of claim 1, wherein the two rows of bristle tufts (24, 26) which divide the head (14) into a first (16), second (18) and third section (20) are in the form of bristle bars.

5. The toothbrush of claim 4, wherein the bristle bars are at least about 0.5 cm in length and about 0.8 mm across.

6. The toothbrush of claim 1, wherein the bristle tufts have a round cross-section of at least 0.25 mm in diameter.

7. The toothbrush of claim 1, wherein the acutely angled inner grouping (28) and the acutely angled outer groupings (24) are angled at the same or different angles, which angle is from about 78 degrees to about 89 degrees with respect to the face (22) of the toothbrush (10).

* * * * *